US008869911B2

(12) United States Patent
Anderson

(10) Patent No.: US 8,869,911 B2
(45) Date of Patent: Oct. 28, 2014

(54) EXTENDABLE MATERIALS BLADE ATTACHMENT FOR A SKID STEER LOADER

(76) Inventor: Alan Anderson, Paradise Hill (CA)

( * ) Notice: Subject to any disclaimer, the term of this patent is extended or adjusted under 35 U.S.C. 154(b) by 0 days.

(21) Appl. No.: 13/173,700

(22) Filed: Jun. 30, 2011

(65) Prior Publication Data

US 2013/0000929 A1 Jan. 3, 2013

(51) Int. Cl.
*E02F 3/76* (2006.01)
*E02F 3/96* (2006.01)
*E02F 3/34* (2006.01)

(52) U.S. Cl.
CPC ..... *E02F 3/3414* (2013.01); *E02F 3/7622* (2013.01); *E02F 3/96* (2013.01)
USPC ..... 172/815; 172/821

(58) Field of Classification Search
USPC ..... 172/817, 821, 373, 815, 823, 828; 37/409, 105, 406; 414/728, 723, 685
See application file for complete search history.

(56) References Cited

U.S. PATENT DOCUMENTS 2,108,466 A * 2/1938 Allin et al. ..... 172/823
2,137,829 A * 11/1938 Austin ..... 172/831
2,224,725 A * 12/1940 Felt, Jr. ..... 172/823
2,348,796 A 5/1944 Ferwerda et al.
2,749,630 A * 6/1956 Nave ..... 172/821
2,755,572 A * 7/1956 Pilch ..... 37/407
3,008,251 A 11/1961 Cline et al.
3,157,099 A * 11/1964 Ulrich ..... 172/815
3,178,046 A * 4/1965 Lull ..... 414/718
3,209,475 A * 10/1965 Salna ..... 37/408
3,231,117 A * 1/1966 Melroe et al. ..... 414/715
3,257,744 A * 6/1966 Fritz ..... 37/105
3,378,084 A * 4/1968 Ulrich ..... 172/247
3,445,944 A * 5/1969 Speno ..... 37/105
3,521,714 A * 7/1970 Farris ..... 172/821
3,539,022 A * 11/1970 Berg ..... 172/819
3,698,487 A * 10/1972 Ruth et al. ..... 172/305
3,991,832 A * 11/1976 Cooper ..... 172/812
4,162,873 A * 7/1979 Smith, Jr. ..... 414/718
4,206,580 A * 6/1980 Truax et al. ..... 56/10.4
4,279,084 A * 7/1981 Low et al. ..... 37/236
4,295,771 A * 10/1981 Mehesan, Jr. ..... 414/5
4,306,832 A * 12/1981 Schmiesing ..... 414/718
4,553,899 A * 11/1985 Magni ..... 414/629

(Continued)

OTHER PUBLICATIONS

"Bobcat Attachments," Bobcat Company, http://www.bobcat.com/attachments/all_attachments, printed Dec. 23, 2011.

(Continued)

*Primary Examiner* — Árpád Fábián-Kovács
(74) *Attorney, Agent, or Firm* — Frost Brown Todd LLC

(57) ABSTRACT

An attachment device can have a distal end; a proximal end; at least one side member extending from the proximal end towards the distal end; a blade member positioned at the distal end and extending generally perpendicular to a direction of travel of the skid steer loader; and at least one actuator operative to move the blade member substantially in a direction of travel of the skid steer loader. Materials can be moved by the attachment device by placing the attachment device along a ground surface so that the materials are placed in front of the blade member and, while the skid steer loader remains stationary, activating the actuator to move the blade member away from the skid steer loader to push the materials.

15 Claims, 4 Drawing Sheets

(56) References Cited

U.S. PATENT DOCUMENTS

| | | | | | |
|---|---|---|---|---|---|
| 4,852,659 | A | * | 8/1989 | Ross et al. | 172/789 |
| 4,854,811 | A | * | 8/1989 | Veys | 414/718 |
| 4,936,392 | A | | 6/1990 | Kitchin | |
| 4,962,598 | A | * | 10/1990 | Woolhiser et al. | 37/231 |
| 4,999,022 | A | * | 3/1991 | Veys | 414/718 |
| 5,075,988 | A | * | 12/1991 | Ciula | 37/231 |
| 5,125,174 | A | * | 6/1992 | Watson et al. | 37/231 |
| 5,209,307 | A | * | 5/1993 | Hotte | 172/445.2 |
| 5,285,588 | A | * | 2/1994 | Niemela et al. | 37/234 |
| 5,507,352 | A | * | 4/1996 | Frisbee et al. | 172/818 |
| 5,701,693 | A | | 12/1997 | Brocious et al. | |
| 5,813,476 | A | * | 9/1998 | Semper | 172/822 |
| 6,024,528 | A | * | 2/2000 | Taylor | 414/495 |
| 6,249,992 | B1 | * | 6/2001 | Irving et al. | 37/281 |
| 6,283,225 | B1 | | 9/2001 | Hermonson | |
| 6,382,329 | B2 | * | 5/2002 | Pitts | 172/784 |
| 6,659,194 | B1 | * | 12/2003 | Thompson | 172/818 |
| 6,796,762 | B2 | * | 9/2004 | Vicars et al. | 414/685 |
| 6,913,086 | B2 | * | 7/2005 | Stevens | 172/815 |
| 7,021,398 | B1 | | 4/2006 | Marshall | |
| 7,228,650 | B2 | * | 6/2007 | Curtis | 37/270 |
| 7,273,111 | B2 | | 9/2007 | Johnson | |
| 7,401,658 | B2 | * | 7/2008 | Matsumoto et al. | 172/811 |
| 7,631,446 | B1 | * | 12/2009 | Davis | 37/444 |
| 7,743,535 | B2 | * | 6/2010 | Goodman et al. | 37/234 |
| 8,103,418 | B2 | * | 1/2012 | Osswald et al. | 701/50 |
| 2001/0009077 | A1 | * | 7/2001 | Pitts | 37/105 |
| 2004/0148822 | A1 | * | 8/2004 | Albright et al. | 37/466 |
| 2006/0210385 | A1 | | 9/2006 | Cook | |
| 2009/0183886 | A1 | * | 7/2009 | Armas | 172/779 |
| 2009/0206589 | A1 | * | 8/2009 | Osswald et al. | 280/782 |
| 2012/0048578 | A1 | * | 3/2012 | Seal | 172/1 |

OTHER PUBLICATIONS

"Two Big Reasons to Get M-Powered," Bobcat Company http://www.bobcat.com/loaders/skidsteer/, printed Dec. 23, 2011.

* cited by examiner

EXTENDABLE MATERIALS BLADE ATTACHMENT FOR A SKID STEER LOADER

The present invention relates to attachments for a skid steer loader or other front end loader and more particularly to an attachment that contains a blade member that can be extended relative to the skid steer loader.

BACKGROUND

Skid steer loaders and other front end loaders are commonly used for moving materials such as earth, etc. around a ground surface. The skid steer loader can often accomplish tasks much faster and on a larger scale than using manual labor.

Skid steer loaders typically have a cab where the operator sits and from which the operator controls the skid steer loader. Along with either wheels or tracks to move the skid steer loader, the operator typically controls a pair of lift arms that are pivotally connected to the sides of the skid steer loader. Typically, these lift arms are powered by hydraulics which the operator controls from the cab of the skid steer loader. In addition to the hydraulics for the lift arms, the operator can have a number of other additional controls for auxiliary elements powered by hydraulics.

Skid steer loader are typically outfitted with a bucket to move materials around. This bucket is attached to the lift arms and an operator of the skid steer loader can move the bucket up and down by controlling the lift arms. Typically, the operator also has hydraulic controls to tilt the bucket. To collect materials from a ground surface, the operator of the skid steer loader places the bucket along a ground surface and then drives the skid steer loader forward to pick up the materials in the bucket. To move the materials in the bucket, the operator than has to move the skid steer loader itself, carrying the materials forward and then depositing the materials in the desired spot.

However, a bucket is not useful for every situation and there are numerous attachments for skid steer loaders that can perform various functions. In some cases, a different attachment than a bucket could be used to provide additional advantages that are not present with the bucket.

SUMMARY OF THE INVENTION

In a first aspect, an attachment device for a skid steer loader is provided. The attachment device can have a distal end and a proximal end; an attachment point located at the proximal end and connectable to the skid steer loader; at least one side member extending from the proximal end towards the distal end; a blade member positioned at the distal end and extending generally perpendicular to a direction of travel of the skid steer loader; and at least one actuator operative to move the blade member substantially in a direction of travel of the skid steer loader.

In a second aspect, a method for moving materials on a ground surface can be provided. The method can comprise: providing a skid steer loader and an attachment device attached to the skid steer loader, the attachment device having: a distal end and a proximal end, an attachment point located at the proximal end and connectable to the skid steer loader; at least one side member extending from the proximal end towards the distal end; a blade member positioned at the distal end and extending generally perpendicular to a direction of travel of the skid steer loader; and at least one actuator operative to move the blade member substantially in a direction of travel of the skid steer loader. The method can then comprise: placing the attachment device along a ground surface so that the materials are placed in front of the blade member; and while the skid steer loader remains stationary, activating the actuator to move the blade member away from the skid steer loader to push the materials.

DESCRIPTION OF THE DRAWINGS

A preferred embodiment of the present invention is described below with reference to the accompanying drawings, in which.

DETAILED DESCRIPTION OF THE ILLUSTRATED EMBODIMENTS

Figure 1:
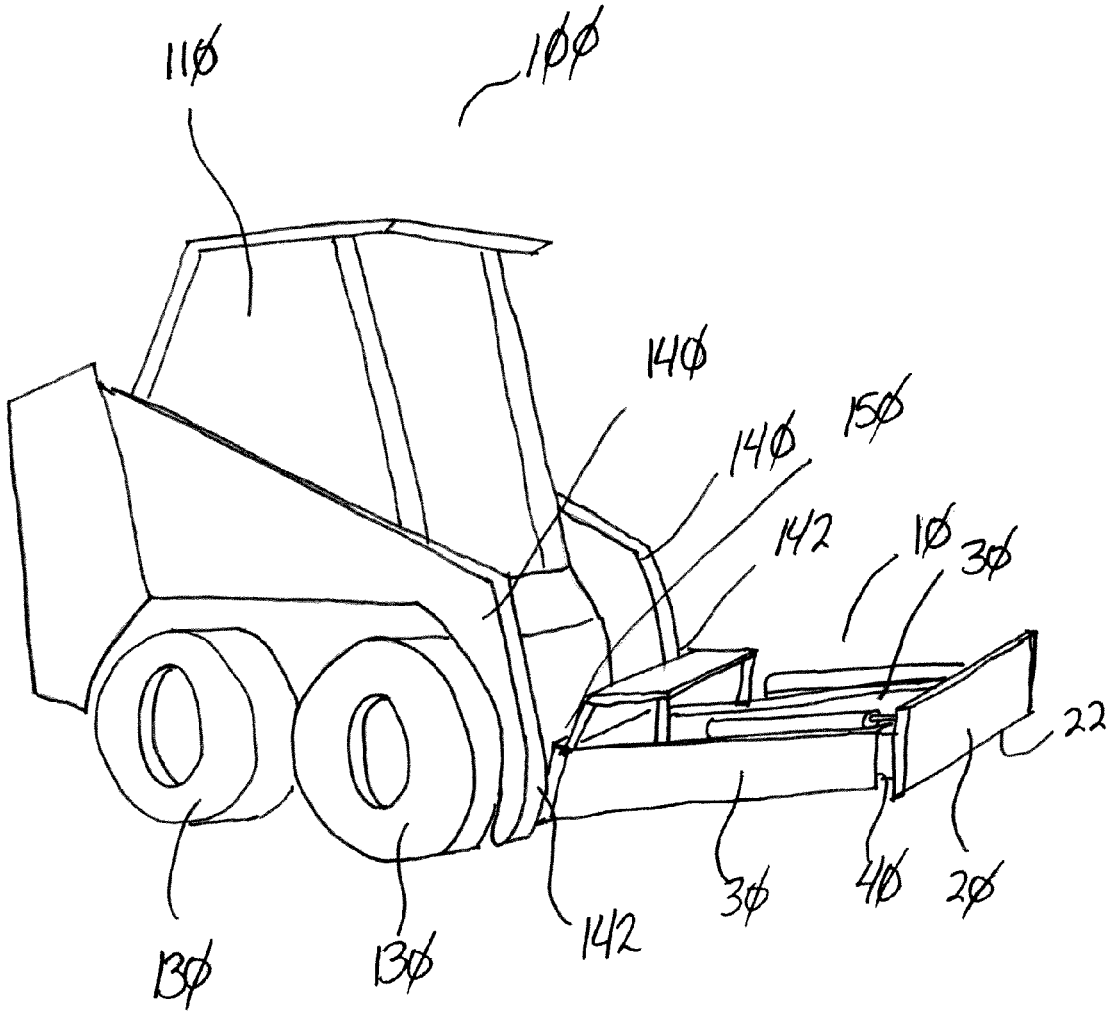
FIG. 1 illustrates a perspective view of a skid steer loader having an attachment.
Figure 2:
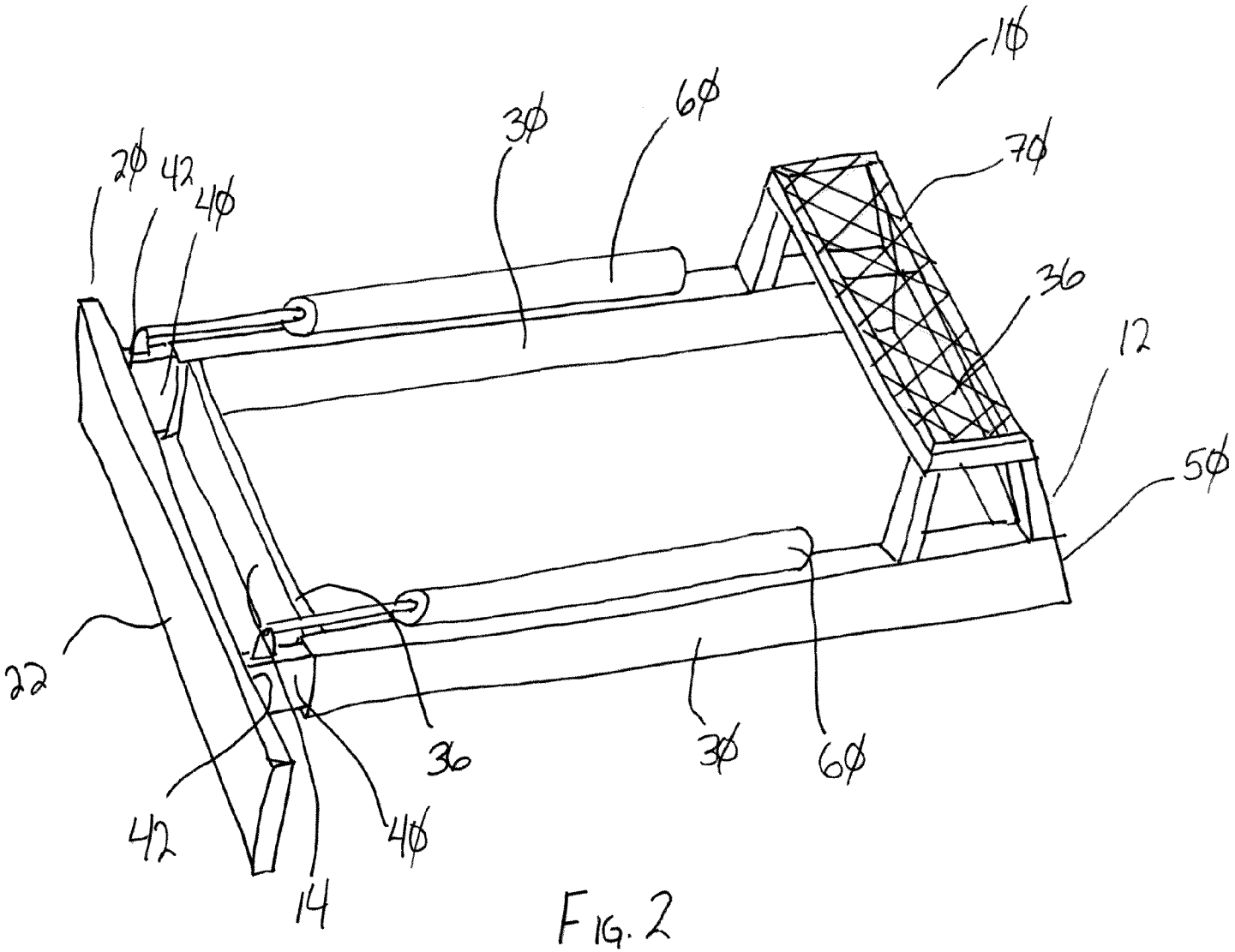
FIG. 2 illustrates a perspective view of an attachment for a skid steer loader.
Figure 3:
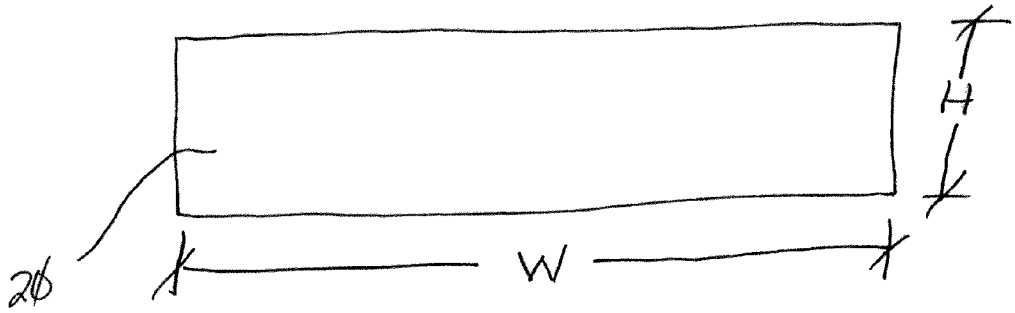
FIG. 3 illustrates a front view of the attachment of FIG. 1.
Figure 4:
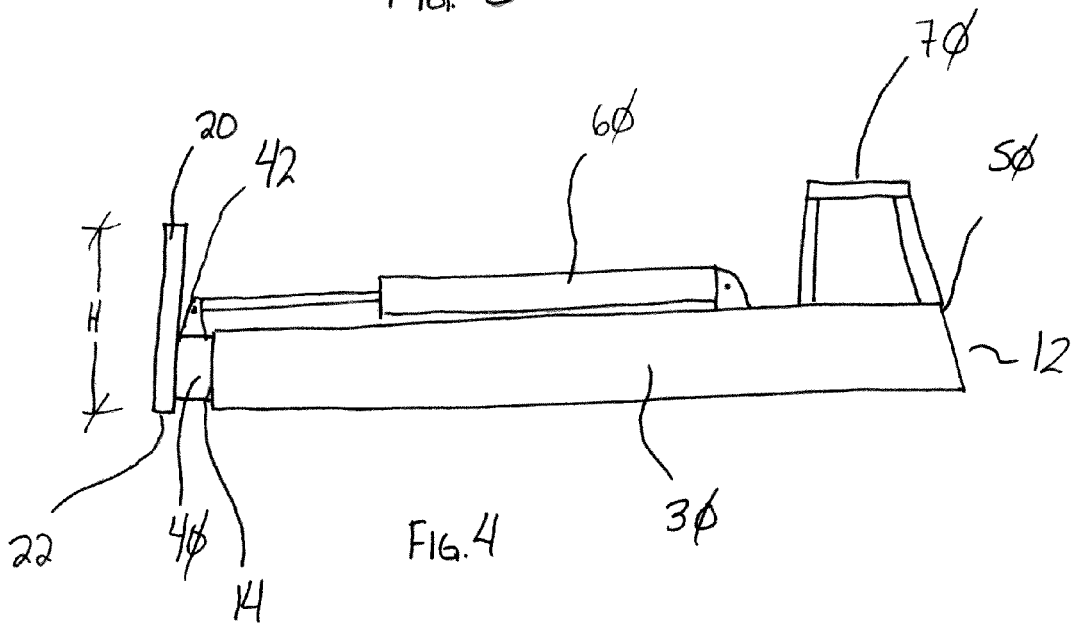
FIG. 4 illustrates a side view of the attachment of FIG. 1.

FIG. 1 illustrates an attachment device 10 attached to the front end of a skid steer loader 100. The attachment device 10 has a materials blade 20 that can be extended relative to the skid steer loader 100. The skid steer loader 100 can comprise a cab 110 where an operator can sit while he or she operates the skid steer loader 100. Wheels 130 can be driven by hydraulics controlled by an operator within the cab 110. Although wheels 130 are shown in FIG. 1 a person skilled in the art will appreciate that the skid steer loader 110 could also be provided with tracks. A pair of lift arms 140 can be provided pivotally connected to the sides of the skid steer loader 100 and controllable by an operator. An operator can raise or lower the lift arms 140 by controlling a flow of hydraulic fluid to hydraulic cylinders (not shown) connected to the lift arms 140.

A plate 150 can be provided between distal ends 142 of the lift arms 140. This plate 150 can received various attachments for the skid steer loader 100. Typically, the plate 150 is rotatable relative to the distal ends 142 of the lift arms 140 using a hydraulic cylinder to allow the operator of the skid steer loader 100 to rotate the plate 150 and thereby the attachment connected to plate 150 relative to the distal ends 142 of the lift arms 140.

The attachment device 10 can be attached the lift arms 140, such as by attaching to the plate 150, so that the attachment device 10 can be raised or lowered by an operator by raising or lowering the lifting arms 140 of the skid steer loader 110.

In one aspect, if the skid steer loader 100 is a Bobcat™ brand skid steer loader, the plate 150 can contain a Bobtach™ attachment system to allow the attachment device 10 to be attached to the skid steer loader 100.

FIGS. 2-6 illustrates the attachment device 10. The attachment device 10 can include: a proximal end 12; a distal end 14; two side members 30; two extending members 40; an attachment point 50; a blade member 20 and a pair of actuators 60.

The attachment device 10 can have a proximal end 12 and a distal end 14 with two side members 30 extending from the distal end 14 of the attachment device 10 along the sides of the attachment device 10. The side members 30 can be spaced apart from one another and substantially parallel to one another. The side members 30 can extend from an attachment point 50 provided proximate the proximal end 12 of the attachment device 10 where the attachment device 10 is attached to the skid steer loader 100.

In one aspect, support members 36 can be provided passing between the side member 30 to increase the strength and rigidity of the attachment device 10.

Extending members 40 can be provided, slidably mounted relative to the side members 30 so that the extending members 40 can move relative to the side members 30. The extending members 40 could be provided so that they extend and retract inside the side members 30, as shown in FIG. 2-6, or alternatively, connected externally to the side members 30 so that they move relative to the side members 30.

A blade member 20 can be attached to the distal ends 42 of the extending members 40, so that the blade member 20 can be moved relative to the vehicle the attachment device 10 is attached to, when the extending members 40 are extended or retracted relative to the side members 30. The blade member 20 can have a width, W, that is greater than the spacings of the two side members 30 and a height, H.

Figure 5:
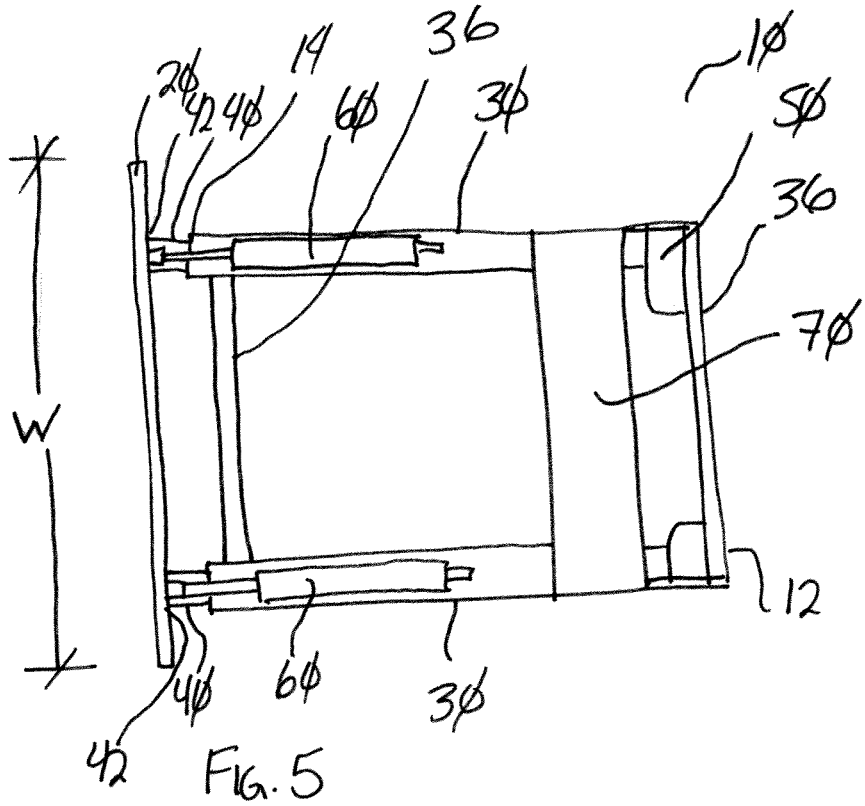
FIG. 5 illustrates a top view of the attachment of FIG. 1 with a blade member in an extended position.
Figure 6:
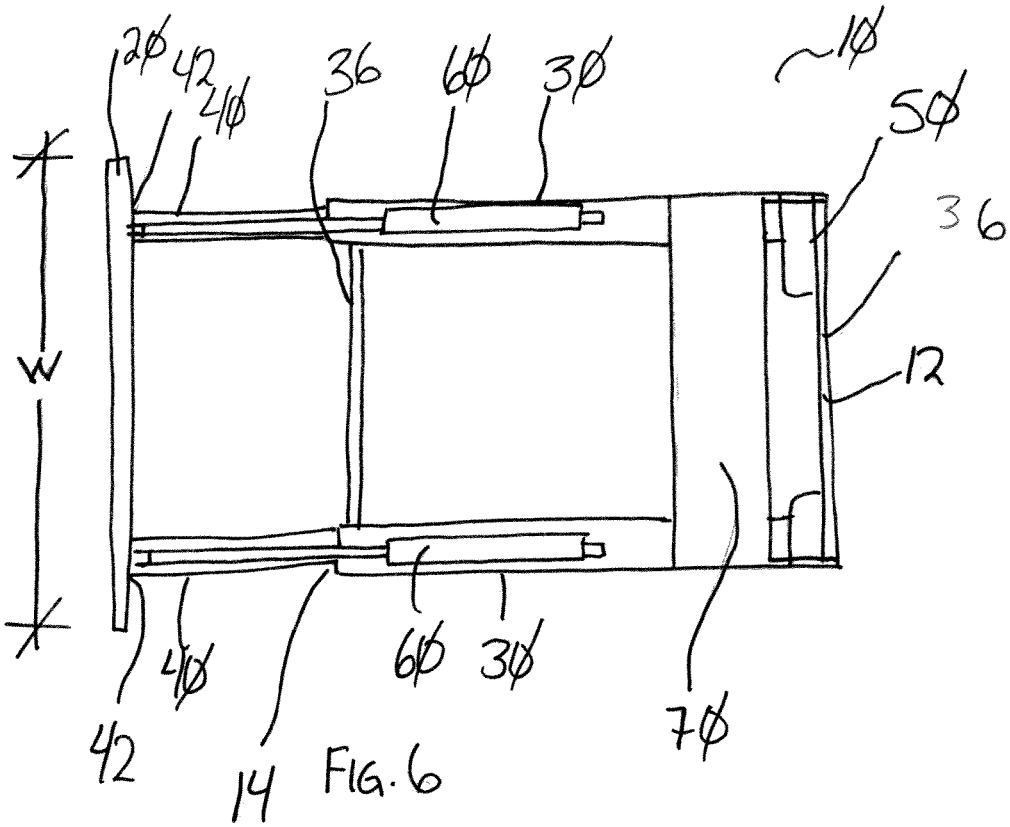
FIG. 6 illustrates a top view of the attachment of FIG. 1 with a blade member in a retracted position

By having the extending members 40 slidably mounted relative to the side members 40, the distal ends 42 of the extending members 40 can be movable relative to the attachment point 50 and the skid steer loader 100 the attachment device 10 is connected to. In this manner, the blade member 20 can be extended relative to the attachment device 10 as shown in FIG. 5 to place the blade member 20 in an extended position or retracted so that the blade member is positioned close to the ends of the side members 30 in a retracted position as shown in FIG. 6. In one aspect, the extension members 40 could be extended almost the same length as the side members 30 so that the distance between the blade member 20 and the ends of the support members 30 is almost the same length as the length of the side members 20 themselves.

The blade member 20 could be generally planar (i.e. positioned substantially in a plane so that the blade member 20 is substantially flat). Alternatively, the blade member 20 can be curved along its height, H, and/or its width, W, depending on the specific application the attachment device 10 is to be used for.

In one aspect, mounting holes can be provided in the blade member 20 so that additional attachments can be connected to the blade member 20.

An actuator 60 such as a hydraulic ram can be provided on each side member 30 connected between the side member 30 and the extending member 40 so that the actuators 60 can be used to extend and retract the extending members 40 relative to the side members 30. By extending the extending members 40 relative to the side members 30, the actuators 60 also extend the distal ends 42 of the extending members 40 and therefore the blade member 20 relative to the side members 30. In this manner, the actuators 60 can control the extension and retraction of the blade member 20. The actuators 60 can be used to move the blade member 20 between its retracted position shown in FIG. 5 and its extended position shown in FIG. 6.

In one aspect, the actuators 60 can be hydraulic rams, with a proximal end 62 of each actuator 60 attached to its respective side member 30 and the distal end 64 of the actuator attached to the extending member 40.

The actuators 60 can be controlled by a user of the skid steer loader 100 from within the cab 110 of the skid steer loader 100 so that the user of the skid steer loader 100 can control the extension and retraction of the blade member 20.

If the actuators 60 are hydraulic rams, a hydraulic connection can be used to allow a user to connect a hydraulic fluid supply from the skid steer loader 100 to the attachment device 10 to direct hydraulic fluid to the actuators 60 allowing the operator to extend and retract the blade member 20. Referring to FIG. 1, an operator by operating controls in the cab 110 of the skid steer loader 110 can control the flow of hydraulic fluid to the hydraulic connection and therefore the actuators 60 on the attachment device 10, thereby controlling the extension and retraction of the blade member 20.

In one aspect, the height, H, of the blade member 20 can be higher than the height of the extending members 30, the side members 30 and the actuators 60 (if the actuators 60 are positioned on top of the side members 30 and the extending members 40) so that an operator can insert the blade member 20 and the attachment device 10 under an overhang. In this manner, if the height, H, of the blade member 20 is less than the overhang, as long as the blade member 20 will fit under the overhang, the extending members 40 and the side members 30 will also fit under the overhang.

The attachment device 10 can have an attachment point 50 that allows the attachment device 10 to be connected to a front of a skid steer loader 100 or other similar vehicle. Referring to FIG. 1, the attachment point 50 can allow the attachment device 10 to be connected to distal ends 142 of the lift arms 140. This attachment point 50 can take a number of forms depending on the specific type of skid steer loader, but in one aspect, it could be a Bob-tach™ plate allowing the attachment device 10 to be attached to a skid steer loader made by Bobcat™.

Referring again to FIGS. 2-4, in one aspect a step 70 can be provided at the proximal end 12 of the attachment device 10. This step 70 can allow an operator to step or stand on the step 70 to make it easier for the operator to gain entry to the skid steer loader 100, which typically has a door to the cab 120 provided at the front of the skid steer loader 100 between the left arms 140.

In one aspect, the step 70 can be positioned proximate the attachment point 50 of the attachment device 10.

Referring to FIGS. 1-4, in operation, a user can attach the attachment device 10 to the front of the skid steer loader 100 by connecting the attachment point 50 of the attachment device 10 to the plate 150 of the skid steer loader 100 so that the attachment device 10 is connected at distal ends 142 of the lift arms 140. If the actuators 60 are hydraulic rams, the user can then attach the hydraulic system of the skid steer loader 100 to the hydraulic connection on the attachment device 10 so that the user can control the operation of the attachment device 10 from the cab 110 of the skid steer loader 100.

With the attachment device 10 connected to the distal ends 142 of the lift arm 140 of the skid steer loader 100, an operator can control the operation of the lift arms 140 so that the attachment device 10 is aligned with a ground surface such that the two side member 30 are positioned substantially parallel to the ground surface. A bottom edge 22 of the blade member 20 can be positioned so that it lies against the ground surface.

A user can maneuver the skid steer loader 100 around using the blade member 20 to push/move soil or other loads around the ground surface, and using the movement of the skid steer loader to move the material around while the blade member 20 remains fixed in place relative to the rest of the attachment device 10 and the skid steer loader 100.

Additionally, the user can stop the skid steer loader 100 and while keeping the skid steer loader 100 stationary, extend the blade member 20 of the attachment device 10 outwards causing the blade member 20 to move soil or other materials along a ground surface while the skid steer loader 100 remains stationary. This can be especially useful when it is desired to move soil, gravel or other materials under an overhang that a conventional bucket will not fit under. The operator of the skid steer loader 100 can drive the skid steer loader 100 up to the overhang pushing the material along with the blade member 20 using the movement of the skid steer loader 100. Once the skid steer loader 100 is stopped in front of the overhang, the operator can extend the blade member 20 of the attachment device 10 and pushing the material under the overhang. Because of the lesser height, H, of the blade member 20, the blade member 20 can be moved underneath the overhang where the skid steer loader 100 and conventional bucket would be unable to reach. As long as the blade member 20 will fit under the overhang, the extension members 40, side members 30 and actuators 60 will also fit under the overhang.

Additionally, the attachment device 10 can allow an operator of a skid steer loader 100 to move materials over a ground surface where it is undesirable or unwise to drive the skid steer loader 100 on such as edges of ditches the operator is filling in with the skid steer loader 100 or over soft and/or wet ground where the skid steer loader 100 could leave ruts. The skid steer loader 100 can be positioned in a stationary position and then the blade member 20 used to move materials into the ditch or onto the ground that the operator does not want to drive on.

The attachment device 10 could also be used to pull materials back towards the skid steer loader 100. The attachment device 10 could be raised off the of the ground surface by the operator of the skid steer loader 100 by the operator using the lift arms 140 to raise the attachment device 10. The attachment device 10 could be extended so that the blade member 20 is extended out from the skid steer loader 100. The operator could then maneuver the skid steer loader 100 so that material to be moved it placed between the extended material blade 20 and the skid steer loader 100. The operator could then lower the attachment device 10 so that the material is positioned between the material blade 20 and the side members 30. By retracting the blade member 20 back towards the skid steer loader 100, the blade member 20 could be used to pull the material towards the skid steer loader 100.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. A method for moving materials on a ground surface, the method comprising:

providing a skid steer loader having a pair of lift arms pivotally connected at first ends to the sides of the skid steer and having distal ends, providing an attachment device having:

a distal end and a proximal end;

at least one side member extending from the proximal end of the attachment device towards the distal end of the attachment device;

a blade member positioned at the distal end of the attachment device and extending generally perpendicular to a direction of travel of the skid steer loader and having a bottom edge; and at least one actuator provided on the attachment device and operative to move the blade member backwards and forwards in a direction that the at least member extends in, attaching the attachment device to the distal ends of the lift arms of the skid steer loader, by releaseably connecting the proximal end of the attachment device to the distal ends of the lift arms of the skid steer loader, using the lift arms to place the attachment device along a ground surface so that the at least one side member is positioned parallel and adjacent along its length to the ground surface, the bottom edge of the blade member lies against the ground surface, the at least one side member extends backwards from and behind the blade member, the attachment device is positioned in front of the skid steer loader and the materials are placed in front of the blade member; and while the skid steer loader remains stationary, activating the actuator to move the blade member away from the skid steer loader and along the ground surface to push the materials.

2. The method of claim 1 wherein the at least one actuator is a hydraulic ram.

3. The method of claim 1 wherein the at least one actuator is operatively connectable to a hydraulic system of the skid steer loader.

4. The method of claim 1 wherein the at least one actuator is connected between the at least one side member and the at least one extending member to extend the at least one extending member relative to the at least one side member.

5. An apparatus comprising:

a skid steer loader having a pair of lift arms pivotally connected at first ends to sides of the skid steer loader, each lift arm having a distal end;

an attachment device having a distal end and a proximal end, the attachment point releaseably connected at the proximal end of the attachment device to the distal ends of the pair of lift arms, the attachment device comprising:

at least one side member extending from the proximal end of the attachment device towards the distal end of the attachment device;

a blade member positioned at the distal end of the attachment device and extending generally perpendicular to a direction of travel of the skid steer loader and having a bottom edge; and at least one actuator provided on the attachment device and operative to move the blade member backwards and forwards in a direction that the at least one side member extends, wherein the attachment device is configured so that when the lift arms are positioned so that the attachment device is adjacent to the ground surface, the at least one side member is positioned parallel and adjacent along its length to the ground surface and the bottom edge of the blade member lies against the ground surface while the at least one side member extends backwards from and behind the blade member and the entire attachment device is positioned in front of the skid steer loader.

6. The skid steer loader of claim 5 wherein a pair of side members extend from a distal end of the attachment device, the pair of side members positioned substantially parallel to one another.

7. The skid steer loader of claim 5 further comprising at least one extending member slidably mounted relative to the at least one side member so that a distal end of the at least one extending member can be extended away from the at least one side member and wherein the blade member is connected to the distal end of the least one extending member.

8. The skid steer loader of claim 7 wherein the at least one actuator is connected between the at least one side member and the at least one extending member to extend the at least one extending member relative to the at least one side member.

9. The skid steer loader of claim 8 wherein the at least one actuator is a hydraulic ram.

10. The skid steer loader of claim 9 wherein the at least one actuator is operatively connectable to a hydraulic system of the skid steer loader.

11. The skid steer loader of claim 7 wherein the blade member has a height and the at least one extending member and the at least one side member have a height that is less than the height of the blade member when the attachment device is positioned with the bottom edge of the blade member against the ground surface and the at least one side member adjacent to the ground surface.

12. The skid steer loader of claim 5 wherein the blade member is substantially positioned within a plane.

13. The skid steer loader of claim 5 having a step provided at the proximal end of the attachment device.

14. The skid steer loader of claim 6 further comprising at least one support member connected between the pair of side members.

15. The skid steer loader of claim 5 further comprising mounting holes placed in the blade member.

* * * * *